US009905204B2

(12) United States Patent
Okimura

(10) Patent No.: US 9,905,204 B2
(45) Date of Patent: Feb. 27, 2018

(54) PIVOTAL SUPPORTING STRUCTURE FOR FALLBOARD OF KEYBOARD MUSICAL INSTRUMENT

(71) Applicant: YAMAHA CORPORATION, Hamamatsu-shi, Shizuoka-Ken (JP)

(72) Inventor: Seiichi Okimura, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/706,250

(22) Filed: May 7, 2015

(65) Prior Publication Data

US 2015/0325219 A1 Nov. 12, 2015

(30) Foreign Application Priority Data

May 9, 2014 (JP) ..... 2014-097473

(51) Int. Cl.
*G10C 3/02* (2006.01)

(52) U.S. Cl.
CPC ..... *G10C 3/02* (2013.01)

(58) Field of Classification Search
USPC ..... 84/179
See application file for complete search history.

(56) References Cited

U.S. PATENT DOCUMENTS 5,056,396 A * 10/1991 Furukawa ..... G10C 3/02 84/179
5,635,655 A * 6/1997 Yamashita ..... G10C 3/02 220/827
5,837,911 A * 11/1998 Inoue ..... E05F 3/14 84/179
5,918,296 A * 6/1999 Ishida ..... G10C 3/02 84/177
5,942,702 A * 8/1999 Inoue ..... G10C 3/02 84/179
6,130,371 A * 10/2000 Inoue ..... G10C 3/02 84/179
6,545,203 B2 * 4/2003 Arimori ..... E05F 5/10 84/179
6,686,521 B2 * 2/2004 Sandifer ..... G10C 3/02 84/179

(Continued)

FOREIGN PATENT DOCUMENTS

JP 3849313 B2 11/2006

*Primary Examiner* — Christopher Uhlir
(74) *Attorney, Agent, or Firm* — Rossi, Kimms & McDowell LLP

(57) ABSTRACT

First and second pivot sections pivotally support left and right end portions of a fallboard on left and right side boards of a keyboard musical instrument, respectively. At least one of the first and second pivot sections includes: a damper mechanism provided on one of the side board and an end portion of the fallboard and having a driven member to receive pivotal movement; and a driving member engageable with the driven member and operable in interlocked relation to the other thereof. The damper mechanism generates a load against pivotal force from the driven member. At least one of the first and second pivot sections includes: a pivoting member pivotally supported on one of the side board and the end portion of the fallboard; and a retainer fixed to the other thereof to position and retain the pivoting member at a predetermined position.

15 Claims, 7 Drawing Sheets

(56) References Cited

U.S. PATENT DOCUMENTS

| | | | | |
|---|---|---|---|---|
| 7,498,502 | B2 * | 3/2009 | Saito | G10D 3/02 84/179 |
| 8,420,917 | B1 * | 4/2013 | Yokozeki | G10C 3/02 84/174 |
| 2013/0008296 | A1 * | 1/2013 | Tsuchimoto | G10C 3/02 84/179 |

* cited by examiner

PIVOTAL SUPPORTING STRUCTURE FOR FALLBOARD OF KEYBOARD MUSICAL INSTRUMENT

BACKGROUND

The present invention relates to a pivotal supporting structure for pivotally supporting a fallboard of a keyboard musical instrument in such a manner that the fallboard is openable and closable relative to the body of the musical instrument.

There have heretofore been known keyboard musical instruments where a fallboard (keyboard fallboard) is pivotally supported relative to the body of the musical instrument with a damper function secured for braking opening/closing movement of the fallboard. In a keyboard musical instrument disclosed in Japanese Patent No. 3849313, the fallboard pivotally mounted on a back lid of the keyboard is pivotally supported on a damper device (damper mechanism section) that is provided on the body of the musical instrument (or instrument body) and that has viscous resistance. In order to absorb misalignment between the pivot axis of the damper device and the pivot axis of the fallboard, a connection member and an absorbing member are interposed between the damper device and the fallboard.

In the pivotal supporting structure disclosed in the above-identified patent literature, however, the fallboard is pivotable relative to the keyboard back lid, and absolutely, the pivot center is a mechanism, such as a hinge, connecting the fallboard and the keyboard back lid for pivotal movement relative to each other. Further, the pivotal supporting structure disclosed in the above-identified patent literature is constructed so that axial misalignment between the pivot axis of the damper device and the fallboard is absorbed by axial misalignment adjusting members comprising the connection member and the absorbing member.

For that purpose, not only a pivotal supporting mechanism, such as the hinge, but also the misalignment adjusting members are essential. Further, because the pivot center of the fallboard does not necessarily coincide with the pivot center of the damper device, there is a likelihood that the damper function will not be exerted uniformly during the entire opening and closing strokes.

If one wants to mount the fallboard on the instrument body in such a manner that the fallboard pivots accurately about the pivot center of the damper device, then a construction corresponding to such a form of mounting has to be considered, which would make it difficult to realize easy mounting of the fallboard.

SUMMARY OF THE INVENTION

In view of the foregoing prior art problems, it is an object of the present invention to provide an improved pivotal supporting structure for a fallboard of a keyboard musical instrument which, without requiring a hinge and a misalignment adjusting member, allows the fallboard to be easily mounted on the instrument body in such a manner that the fallboard can pivot about the pivot center of the damper mechanism section.

In order to accomplish the above-mentioned object, the present invention provides an improved pivotal supporting structure for a fallboard (10) of a keyboard musical instrument, the fallboard (10) being disposed between left and right side boards (11, 12) of the keyboard musical instrument, the pivotal supporting structure comprising: a first pivot section (J1, 20) that pivotally supports a left end portion (10*a*) of the fallboard on the left side board (11); a second pivot section (J2, 30) that pivotally supports a right end portion (10*b*) of the fallboard on the right side board (12). At least one of the first pivot section and the second pivot section includes: a damper mechanism (DM) provided on one of the side board and the end portion of the fallboard and having a driven member (29) constructed to receive pivotal movement; and a driving member (23, 123) corresponding to the damper mechanism (DM) and engageable with the driven member, the driving member (23, 123) being assembled so as to operate in interlocked relation to the other of the side board and the end portion of the fallboard, the damper mechanism being constructed to generate a load against pivotal force which the driven member (29) receives from the driving member (23, 123). Further, at least one of the first pivot section and the second pivot section includes: a pivoting member (38) pivotally supported on one of the side board and the end portion of the fallboard; and a retainer (30, 33, 36) corresponding to the pivoting member and fixed to other of the side board and the end portion of the fallboard, the retainer being constructed to position and retain the pivoting member at a predetermined position. Note that numerals and characters indicated in parentheses in this summary section represent, just for reference purposes, reference numerals and characters used in the accompanying drawings to depict various constituent elements of later-described embodiments of the present invention.

According to the present invention, the pair of the damper mechanism (DM) and the driving member (23, 123) is provided on at least one of the left and right pivot sections (J1, J2), the pivot center of the driven member (29) of the damper mechanism (DM) becomes a pivot axis of the fallboard on at least one end portion of the fallboard as the fallboard is pivotally opened or closed. The damper mechanism (DM) is provided on one of the side board and the end portion of the fallboard, and the driving member (23, 123) is assembled so as to operate in interlocked relation to the other of the side board and the end portion of the fallboard. Provision of such a damper mechanism (DM) can provide a stable pivoting touch as the fallboard is opened or closed. Further, the pair of the pivoting member (38) and the retainer (30, 33, 36) is provided on at least one of the left and right pivot sections (J1, J2), and the pivot axis of the pivoting member (38) coincides with the pivot axis of the fallboard on at least one end portion of the fallboard as the fallboard is pivotally opened or closed. Because the pivoting member (38) is positioned and retained at the predetermined position via the retainer (30, 33, 36), the fallboard is assembled to the side board in such a manner that it is pivotable relative to the side board. Because the pivoting member extends in a direction perpendicular to the pivot axis, a direction of relative movement of the pivoting member when the pivoting member is to be assembled to or removed from the retainer is generally perpendicular to the pivot axis, the pair of the pivoting member (38) and the retainer (30, 33, 36) can be easily constructed so that, when operations are to be performed for assembling the fallboard to the side boards or removing the fallboard from the side boards, the fallboard only has to be moved in a direction generally perpendicular to the pivot axis, i.e. in an up-down or front-rear direction or the like, as viewed from the front of the keyboard, or in other words, in a direction other than a left-right (lateral) direction where the fallboard is sandwiched by the left and right side boards so that it cannot be easily moved. Such a construction can facilitate assembly to or removal from the body of the musical instrument. In this way, the fallboard can be readily mounted on the body of the musical instrument (instrument body) between the left and right side boards in such a manner that it is pivotable about the pivot center of the damper mechanism, without requiring a hinge and an axial misalignment adjusting member.

In an embodiment, the pair of the damper mechanism and the driving member may be provided on any one of the first and second pivot sections. However, the present invention is not so limited, and the pair of the damper mechanism and the driving member may be provided on each of the first and second pivot sections; namely, two pairs of the damper mechanisms and the driving members may be provided.

In an embodiment, the pair of the pivoting member and the retainer may be provided on any one of the first and second pivot sections. However, the present invention is not so limited, and, as another embodiment, the pair of the pivoting member and the retainer may be provided on each of the first and second pivot sections; namely, two pairs of the pivoting members and the retainers may be provided.

In an embodiment, the pair of the damper mechanism and the driving member and the pair of the pivoting member and the retainer may be provided on different ones of the first and second pivot sections; namely, one of the pairs may be provided on the first pivot section, and the other of the pairs may be provided on the second pivot section. In another embodiment, the pair of the damper mechanism and the driving member and the pair of the pivoting member and the retainer may both be provided on the same pivot section; namely, both of the pairs may be provided on the same first or second pivot section.

In an embodiment, if the pivoting member is not provided on the at least one of the first joint section and the second joint section which includes the pair of the damper mechanism and the driving member, the driving member may be fixed to the other of the side board and the end portion of the fallboard where the damper mechanism is not provided. If the pivoting member is provided on the at least one of the first joint section and the second joint section which includes the pair of the damper mechanism and the driving member, the driving member may be constructed to pivot together with said pivoting member.

In an embodiment, the pivoting member may include a pivoting arm, the retainer includes a gap space that removably receives therein the pivoting arm, a positioning member for positioning the pivoting arm received in the gap space, and a fixing member for fixing the pivoting arm received and positioned in the gap space. With such arrangements, the pivoting arm can be easily positioned at the predetermined position by merely being inserted into the gap space of the retainer.

In an embodiment, the pivoting member may include a shaft section pivotably supporting the pivoting arm, and the positioning member may have a recessed portion that engages with the shaft section of the pivoting arm received in the gap space. Because the pivoting member is positioned by the shaft section, which pivotably supports the pivoting arm, being engaged with the recessed portion, the pivoting member can be positioned with a high accuracy with the pivot axis as a positioning reference. Further, in an embodiment, the recessed portion may have a bottom end portion, and the pivoting member may be positioned by abutting engagement between the bottom end portion and the shaft section. Because it suffices to insert the pivoting member into the gap space of the retainer until the shaft section of the pivoting member abuts against the bottom end portion of the recessed portion, the positioning of the pivoting member can be significantly facilitated.

Further, in an embodiment, the fixing member may include a fastening screw, and the pivotal supporting structure may be constructed in such a manner that a portion fastened by the fastening screw is exposed when the fallboard is in an opened position. Such arrangements can facilitate fastening operation by the fastening screw. Furthermore, in an embodiment, the pivotal supporting structure may be constructed in such a manner that the portion fastened by the fastening screw is invisible from outside when the fallboard is in a closed position. With such an arrangement, the outer appearance of the pivotal supporting structure can be improved because the portion fastened by the fastening screw is invisible from outside when the fallboard is in the closed position.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

Figure 1:
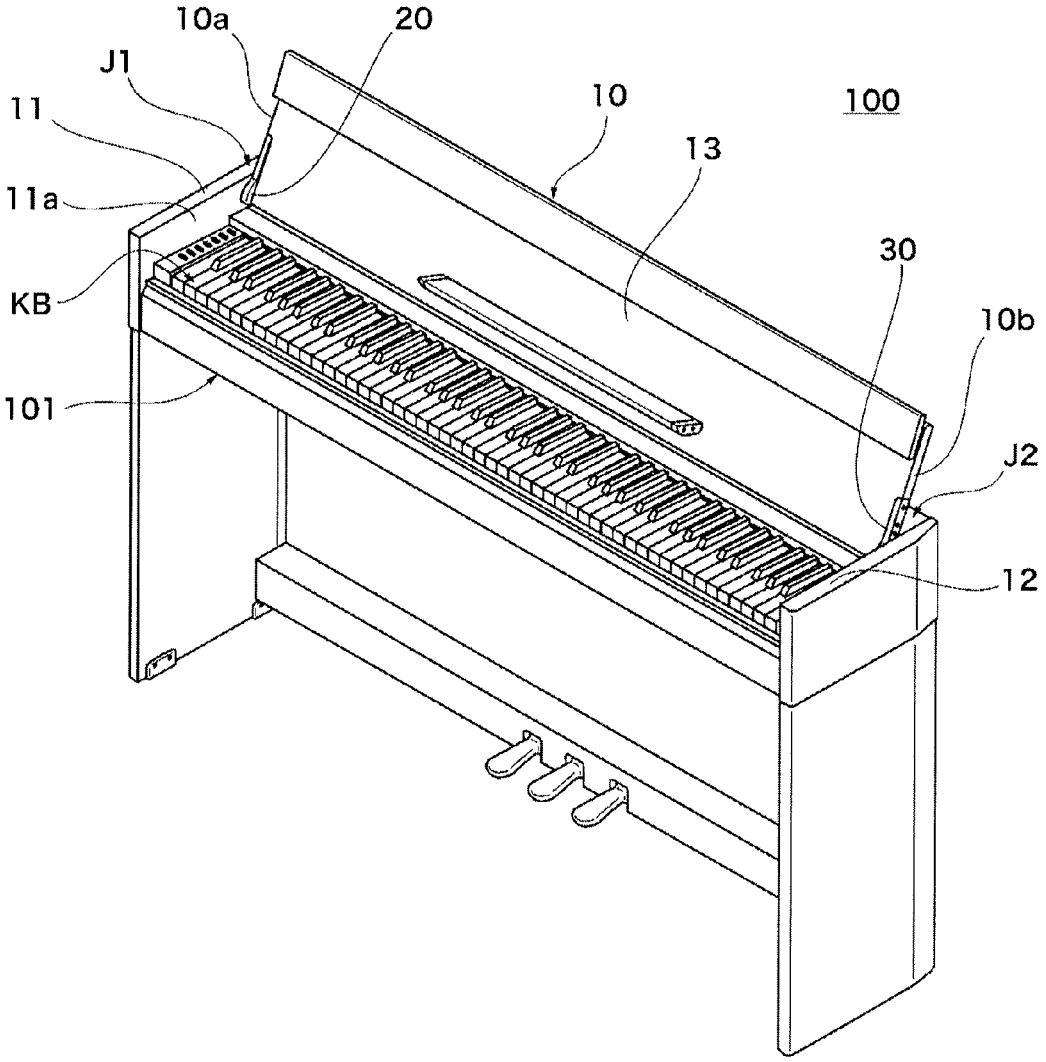
FIG. 1 is a perspective view of a keyboard musical instrument to which is applied a pivotal supporting structure for a fallboard according to an embodiment of the present invention, which particularly shows a fallboard-opened state of the keyboard musical instrument.

FIG. 1 is a perspective view of a keyboard musical instrument 100 to which is applied a pivotal supporting structure for a fallboard (keyboard fallboard) according to an embodiment of the present invention, which particularly shows a fallboard-opened state of the keyboard musical instrument. Although the keyboard musical instrument 100 is constructed as an electronic keyboard musical instrument, it may be an acoustic keyboard instrument.

The keyboard musical instrument 100 includes an instrument body 101 and a fallboard 10, and a keyboard section KB is mounted on the instrument body 101. Hereinafter, the terms "left", "right", etc. refer to directions as viewed from a human operator or player sitting behind the keyboard section KB.

The instrument body 101 includes a left side board 11 and a right side board 12, and the keyboard section KB and the fallboard 10 are disposed between the left and right side boards 11 and 12. The fallboard 10 includes a plate section 13 that covers the keyboard section KB when the fallboard 10 is in a closed position. The plate section 13 functions also as a music stand. A left pivot section J1 is provided on the left side board 11, while a right pivot section J2 is provided on the right side board 12. The fallboard 10 is openable and closable relative to the instrument body 101 about a pivot center that is an axis line extending in a horizontal left-right direction on a front side (i.e., side remote from the human player) of the keyboard section KB. As will be described in detail later, the above-mentioned pivot center (or pivot axis) of the fallboard 10 is set by a left end portion 10*a* of the fallboard 10 being pivotally supported by the left pivot section J1 and a right end portion 10*b* of the fallboard 10 being pivotally supported by the right pivot section J2. The left and right pivot sections J1 and J2 axially align with each other and thereby define a pivot axis line of the fallboard 10.

A mounting section 20 is fixed to the plate section 13 on the left end portion 10*a* of the fallboard 10, while a mounting section 30 is fixed to the plate section 13 on the right end portion 10*b* of the fallboard 10. The mounting section 20 and 30 engage with the left and right pivot sections J1 and J2, respectively. Namely, a combination of the left pivot section J1 and the mounting section 20 functions as a first pivot section for pivotally supporting the left end portion 10*a* on the left side board 11, while a combination of the right pivot section J2 and the mounting section 30 functions as a second pivot section for pivotally supporting the right end portion 10*b* on the right side board 12.

Figure 2:
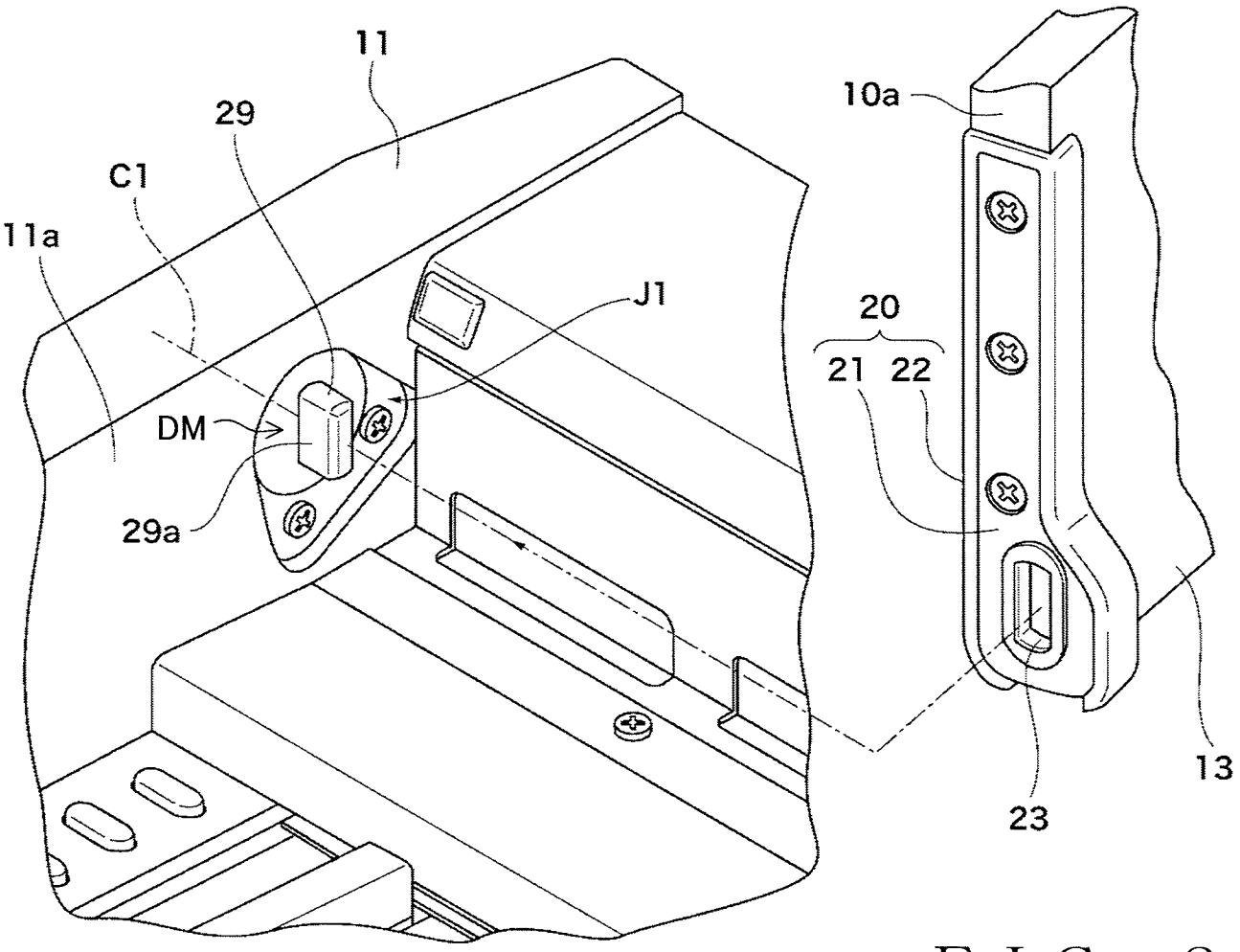
FIG. 2 is a fragmentary exploded perspective view showing a relationship between a left pivot section and a mounting section.

FIG. 2 is a fragmentary exploded perspective view showing a relationship between the left pivot section J1 and the mounting section 20.

The left (first) pivot section J1 includes a pair of a damper mechanism DM and an engaging hole 23. For example, the damper mechanism DM may be of a conventionally-known construction using a friction generating member having fluid viscosity resistance and slide resistance. The damper mechanism DM has a projection 29 that functions as a pivot shaft rotatable about a first pivot axis C1, and the projection 29 is, for example, in the form of an elongated ridge or a rectangular parallelepiped. The projection 29 is exposed in the inner surface 11*a* of the left side board 11 and functions as a driven member. Once the projection 29 receives pivotal driving force acting about the first pivot axis C1, the pivot section J1 generates a load against the pivotal driving force. The damper mechanism DM only needs to have a damper function for braking pivoting movement and may be constructed in any desired manner. Note that the pivot axis C1 of the driven drive member (projection 29) in the damper mechanism DM forms a pivot axis in the pivot section J1.

The mounting section 20, which is fixed to the plate section 13 of the fallboard 10 by means of screws or the like, comprises a metal part 21 and a cover 22 covering the metal part 21. The metal part 21 and the cover 22 may be formed integrally, and the metal part 21 has the engaging hole 23 formed therein.

As viewed in the axial direction of the first pivot axis C1, the projection 29 has a generally rectangular shape, rather than a circular shape, and has a flat driven surface 29*a*. The engaging hole 23 is shaped in such a manner that it can be fitted over the projection 29 to engage with the projection 29 in a pivoting direction to thereby drive the projection 29 in the pivoting direction. When the engaging hole 23 is fitted over the projection 29, pivoting force (pivotal driving force) of the mounting section 20 responsive to opening/closing movement of the fallboard 10 is transmitted to the projection 29 via the engagement between the engaging hole 23 and the projection 29. The engaging hole 23 is provided in the mounting section 20 in correspondence with the damper mechanism DM and functions as a driving member engageable with the driven member (projection 29). The driving member (engaging hole 23) is assembled so as to operate in interlocked relation to one of the side board 11 and 10 end portion 10*a* of the fallboard 10 where the damper mechanism DM is not provided. In the illustrated example of FIG. 2, interlocked relation of the driving member (engaging hole 23) with the fallboard 10 is realized by the driving member (engaging hole 23) being provided on the mounting section 20 fixed to the end portion 10*a* of the fallboard 10.

As the fallboard 10 duly assembled is pivotally moved in an opening or closing direction, the mounting section 20 including the engaging hole 23 pivots together or integrally with the fallboard 10 as a part of the fallboard 10, so that the engaging hole 23 pivotally drives the projection 29. Then, the damper mechanism DM generates a load to brake the fallboard 10. Thus, by the engagement between the engaging hole 23 and the projection 29, not only pivotal driving force is applied to the damper mechanism DM during the opening/closing movement of the fallboard 10, but also the left end portion 10*a* is pivotally supported on the left side board 11 with the first pivot axis C1 as the center of axis.

Figure 3:
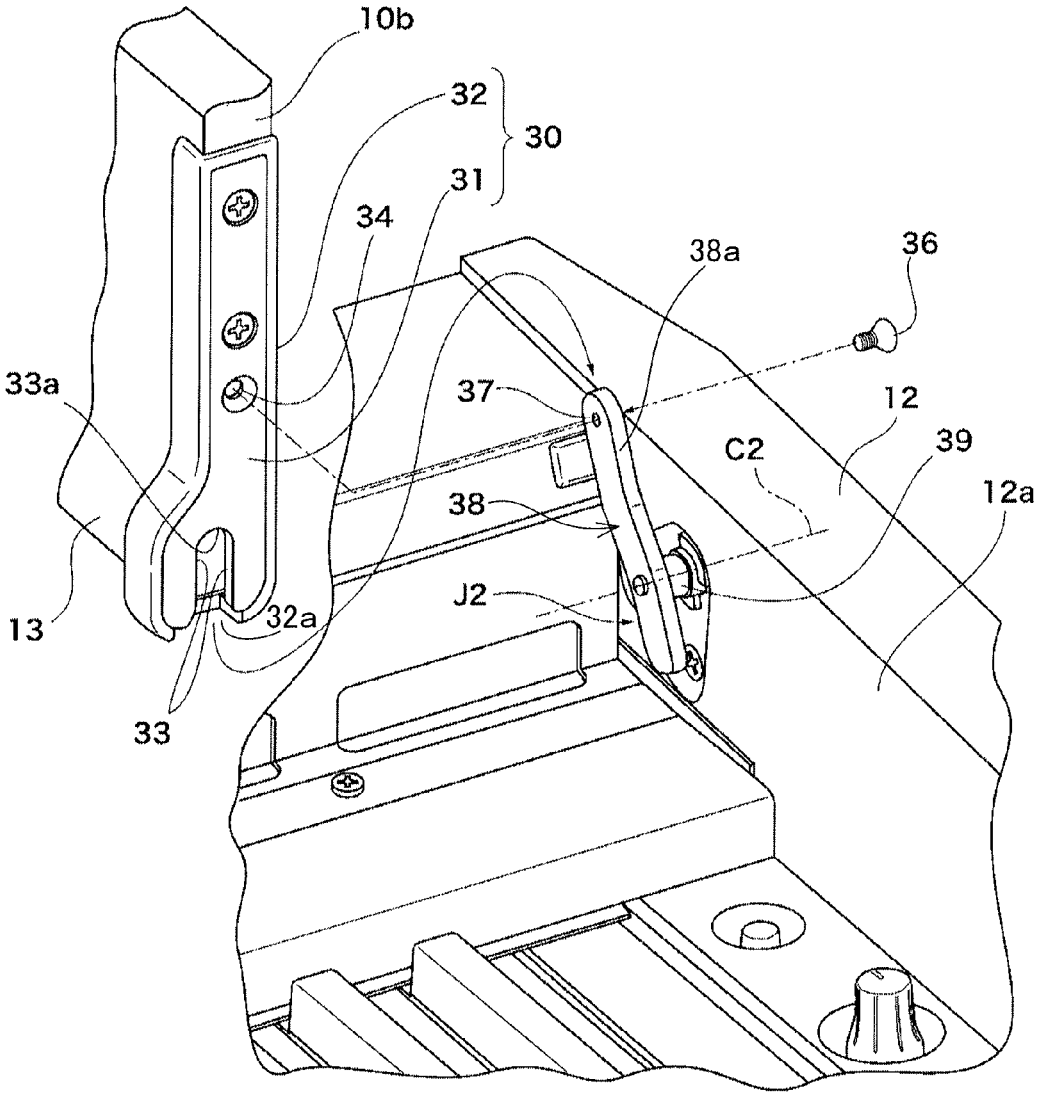
FIG. 3 is a fragmentary exploded perspective view showing a relationship between a right pivot section and a mounting section.

FIG. 3 is a fragmentary exploded perspective view showing a relationship between the right pivot section J2 and the mounting section 30.

The right (second) pivot section J2 includes a pivoting member 38 pivotally supported on the right side board 12, and a retainer (including a mounting section 30, a recessed portion 33, a male screw 36, etc.) fixed to the right end portion 10*b* of the fallboard 10. A shaft section 39 rotatable about a second pivot axis C2 projects leftward from the inner surface 12*a* of the right side board 12, and the pivoting member 38 is fixed to the shaft section 39 so as to rotate together or integrally with the shaft section 39. The first pivot axis C1 and the second pivot axis C2 are axially aligned with each other, and these first and second pivot axes C1 and C2 form a pivot center (axis line) of the fallboard 10 duly assembled.

The pivoting member 38 includes an arm 38*a* extending radially so that the arm 38*a* pivots in a plane perpendicular to the axis line of the second pivot axis C2, and a fastening hole 37 formed as a female thread is formed in one of free end portions of the pivoting member 38. Note that the shaft section 39 need not necessarily be rotatable and may be fixed to the right side board 12, in which case it suffices that the pivoting member 38 be pivotable relative to the shaft section 39 about the second pivot axis C2; in short, it is only necessary that the pivoting member 38 (arm 38*a*) be constructed to be pivotable about the second pivot axis C2. Note that the pivoting member 38 may be of any desired shape.

Figure 4A:
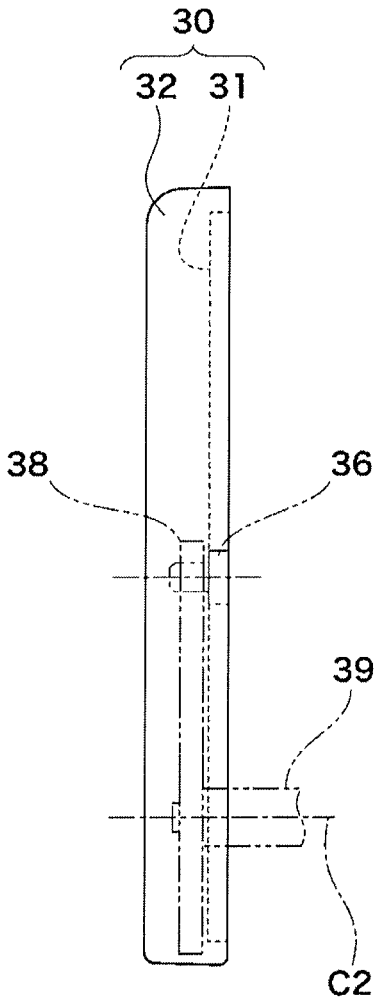
FIG. 4A is a front view of the mounting section.
Figure 4B:
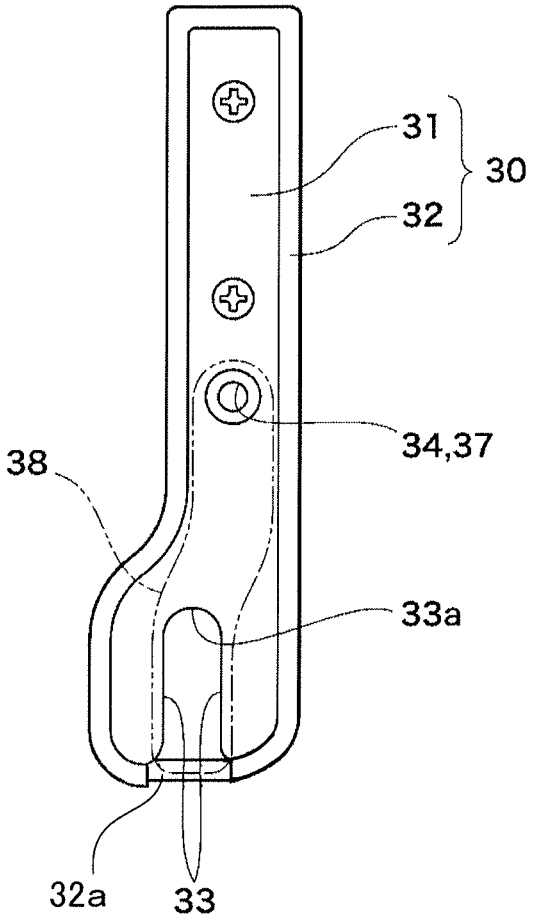
FIG. 4B is a right side view of the mounting section.

FIG. 4A is a front view of the mounting section 30, and FIG. 4B is a right side view of the mounting section 30.

As shown in FIGS. 3, 4A and 4B, the mounting section 30 is fixed to the plate section 13 of the fallboard 10 by screws or the like. The mounting section 30 comprises a metal part 31 and a cover 32 covering the metal part 31. In the metal part 31 are formed the recessed portion 33 of a generally inverted U shape to permit entry therein of the shaft section 39, and a fastening hole 34 corresponding to the fastening hole 37 of the pivoting member 38. The fastening hole 34 need not be threaded. An opening 32*a* is formed in a lower end portion of the cover 32 that positionally corresponds to an entrance to the recessed portion 33. A gap space communicating with the opening 32*a* is formed between the end portion 10*b* of the fallboard 10 and the metal part 31, and the arm 38*a* of the pivoting member 38 is insertable in the gap space.

The recessed portion 33 extends in a longitudinal direction of the metal part 31 and has a bottom end portion 33*a* of a semicircular concave shape. Namely, with the pivoting member 38 duly assembled to the mounting section 30, the recessed portion 33 extends in a direction perpendicular to the axis line of the second pivot axis C and ends in the bottom end portion 33*a*. With the pivoting member 38 duly assembled to the mounting section 30, the bottom end portion 33*a* abuts against the shaft section 39 and thereby functions as a means for positioning the pivoting member 38 at a predetermined position. With the pivoting member 38 duly assembled to the mounting section 30 and positioned at the predetermined position in the aforementioned manner, the fastening hole (female thread) 37 of the pivoting member 38 (arm 38*a*) faces the fastening hole 34 of the metal part 31, and thus, the male screw 36 can be screwed into the fastening hole (female thread) 37 by being inserted into the fastening hole 34 and tightened to be tightened. In this manner, the pivoting member 38 is fixed to the mounting section 30. The mounting section 30, including the above-mentioned metal part 31, cover 32, recessed portion 33, pivoting-member-inserting gap space, etc., and the fixing screw 36 function as a retainer for retaining the pivoting member 38 at the predetermined position.

Next, a description will be given about an example operational sequence for mounting the fallboard 10 on the keyboard musical instrument 100.

The fallboard 10 having the mounting sections 20 and 30 fixed to the plate section 13 is fabricated in advance. First, the engaging hole 23 (FIG. 2) of the left mounting section 20 of the fallboard 10 is fitted over and fittingly engaged with the projection 29 of the damper mechanism DM provided on the left side board 11. Then, with the engaging hole 23 and the projection 29 kept fittingly engaged with each other, a portion of the fallboard 10, mainly the right end portion 10*b*, is moved downward so that the pivoting member 38 (FIG. 3) provided on the right side board 12 is inserted, from below, into the gap space of the right mounting section 30 of the fallboard 10. Because the downward movement of the fallboard 10 at that time is in an up-down or front-rear direction substantially perpendicular to the pivot axis of the fallboard 10, the fallboard 10 can be moved easily so that the pivoting member 38 can be inserted into the gap space, and thus, the mounting operations can be extremely facilitated.

As noted above, the gap space in which the pivoting member 38 is insertable is formed inside the cover 32 between the end portion 10*b* of the fallboard 10 and the metal part 31, and the opening 32*a* is formed in a portion of the cover 32 that positionally corresponds to the entrance to the recessed portion 33. As the free end portion of the pivoting member 38, where the fastening hole 37 is located, is inserted through the opening 32*a*, the recessed portion 33 is brought into engagement with the shaft section 39 and then guided by the shaft section 39 until then the bottom end portion 33*a* is brought into abutment against the shaft section 39.

Once the bottom end portion 33*a* abuts against the shaft section 39, the mounting section 30 and the pivoting member 38 are placed in a positional relationship as shown in FIGS. 4A and 4B. In this manner, the positioning function for positioning the pivoting member 38 and the mounting section 30 in the direction vertical to the axial direction of the second pivot axis C2 can be performed by the engagement between the recessed portion 33 and the shaft section 39.

Once the pivoting member 38 and the mounting section 30 are duly positioned in the aforementioned manner, the fastening hole 34 and the fastening hole 37 are linearly aligned with each other. In this condition, the screw 36 is screwed through the fastening hole 34 into the fastening hole 37, so that the pivoting member 38 and the mounting section 30 are fixedly fastened together. This fastening operation is performed with the fallboard 10 kept in the opened position. Because the fastening hole 34 is exposed rightward when the fallboard 10 is the opened position, the fastening operation can be done with ease. When the fallboard 10 is in the closed position, on the other hand, the fastening hole 34 is invisible as viewed from the right by being hidden behind the right side board 12 and thus the portion fastened by the screw 36 is invisible, with the result that the outer appearance would not be impaired.

Even if the recessed portion 33 is formed to be longer in length such that the pivoting member 38 is fixed to the mounting section 30 by means of the screw 36 with no abutment between the bottom end portion 33*a* and the shaft section 39, a certain degree of the positioning function can be performed. In such a case, the mounting section 30 is moved in a direction where the recessed portion 33 is movable while being guided by the shaft section 39, and then the fastening hole 37 and the fastening hole 34 are positioned in linear alignment with each other by the eye of a human operator and then fastened together by the screw 36.

In this way, the fallboard 10 can be mounted on the instrument body 101 by means of substantively one fastener member (screw 36) in such a manner that the fallboard 10 is pivotable about the first and second pivot axes C1 and C2. Further, no hinge or the like is required to permit pivoting movement of the fallboard 10. Furthermore, no dedicated mechanism for correcting axial misalignment is required to permit the fallboard 10 to pivot about the second pivot axis C2.

Because the engaging hole 23 of the mounting section 20 pivotally drives the projection 29 of the pivot section J1 in response to an opening/closing operation of the fallboard 10, the pivot section J1 generates a load against the pivotal driving force such that appropriate brake force is applied to the opening/closing movement of the fallboard 10. Note that, when the fallboard 10 is to be removed, fallboard removing operations may be performed by first removing the screw 36 and then merely reversing the aforementioned operational sequence executed for mounting the fallboard 10. Thus, the fallboard removing operations can be facilitated for reasons similar to the reasons set forth above for the fallboard mounting operations.

According to the instant embodiment, as the pivoting member 38 is inserted into the mounting section 30 with the engaging hole 23 and the projection 29 kept engaged with each other, the pivoting member 38 and the mounting section 30 are positioned relative to each other in the front-rear and up-down directions. Then, by screwing the screw 36 through the fastening hole 34 into the fastening hole 37 in that condition, the pivoting member 38 and the mounting section 30 can be fixedly fastened together. In this way, the fallboard 10 can be readily mounted on the instrument body 101 so that it can pivot about the pivot axis (C1) of the damper mechanism section (pivot section J1), without requiring a hinge and an axial misalignment adjusting member.

Further, because the pivoting member 38 and the mounting section 30 are positioned through the engagement between the recessed portion 33 and the shaft section 39, the positioning can be facilitated. Particularly, through the abutment between the bottom end portion 33 and the shaft section 39, the pivoting member 38 and the mounting section 30 can be positioned relative to each other in the direction vertical to the second pivot axis 39. Besides, the shaft center of the shaft section 39 is the second pivot axis C2. In this way, the pivoting member 38 and the mounting section 30 can be positioned on the basis of the second pivot axis C2 (i.e., with the second pivot axis C2 used as a positioning reference), and thus, they can be positioned with a high accuracy.

Further, if the fallboard 10 is placed in the opened position with the pivoting member 38 and the mounting section 30 kept duly positioned relative to each other in the aforementioned manner, the fastening hole 34 is visibly exposed rightward, and thus, the fastening operation can be performed with ease. If the fallboard 10 is placed in the closed position after assembly, on the other hand, the fastening hole 34 is invisible as viewed from the right by being hidden behind the right side board 12 and thus the fastened portion is invisible, with the result that the outer appearance can be improved.

Whereas the construction in which the projection 29 (driven section or member) is driven by the engaging hole 23 functioning as a driving member has been described above by way of example in relation to the mechanism of the section where the mounting section 20 drives the pivot section J1 in response to the opening/closing movement of the keyboard 10, the present invention is not so limited. For example, as shown in FIG. 5, the driven member provided in the pivot section J1 may be constructed to be subjected to (receive) pivotal driving force acting about the first pivot axis C1, and the driving member provided in the mounting section 20 may be constructed in a manner corresponding to such a driven member.

Figure 5:
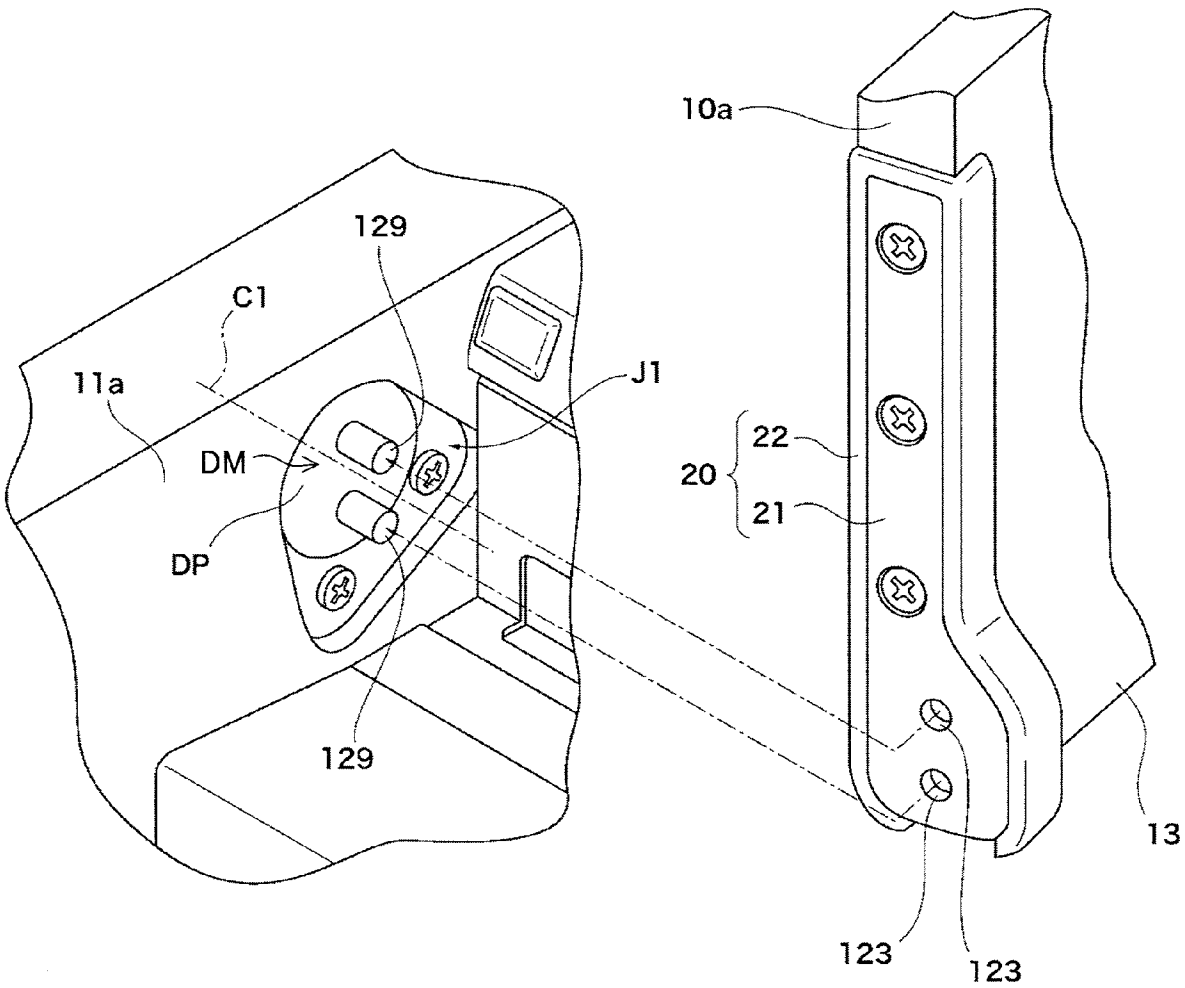
FIG. 5 is a fragmentary exploded perspective view showing a relationship between the left pivot section and the mounting section according to a modification of the present invention.

FIG. 5 is a fragmentary exploded perspective view showing a relationship between the left pivot section J1 and the mounting section 20 according to a modification (modified embodiment) of the present invention. The pivot section J1 has two projections 129 as the driven members, and the mounting section 20 has two engaging holes 123 formed therein as the driving members. The engaging holes 123 are fitted over respective ones of the projections 129 so that the engaging holes 123 can apply pivotal driving force to the corresponding projections 129.

Alternatively, two recessed portions may be formed in a surface DP in place of the two projections 129, and two projections corresponding to the recessed portions may be provided, by welding or otherwise, on the metal part 21 in place of the engaging holes 123 so that the recessed portions and the projections can be fitted with each other.

Various other structural relationships between the driving member and the driven member are also possible. For example, three or more projections 129 and three or more engaging holes 123 may be combined. Further, the projection 29 shown in FIG. 2 may be of any desired special shape having the driven surface 29*a* unless the shape is a circular columnar shape. For example, the projection 29 may be of a plus (+) shape, flower shape, polygonal shape, circle segment shape, half moon shape, or the like.

Furthermore, the construction with which to provide the mounting sections 20 and 30 on the fallboard 10 may be other than the one described above. For example, the engaging hole 23 of the mounting section 20 and the recessed portion 33 of the mounting section 30 may be formed in the body of the fallboard 10 itself.

Furthermore, the positional relationship between the damper mechanism DM and the mounting section 20 constituting the first pivot section J1 may be reversed. Namely, the damper mechanism DM may be provided on the end portion 10*a* of the fallboard 10, and a mounting mechanism corresponding to the mounting section 20 may be provided on the left side board 11. In this manner, the damper mechanism DM provided on the fallboard 10 can be pivotally driven by the mounting mechanism provided on the left side board 11.

Similarly, the positional relationship between the pivoting member 38 and the mounting section 30 (retainer) constituting the second pivot section J2 may be reversed. Namely, a pivoting mechanism corresponding to the shaft section 39 and the pivoting member 38 may be provided on the end portion 10*b* of the fallboard 10, and a mounting mechanism corresponding to the mounting section 30 (retainer) may be provided on the right side board 12. In such a case, with the fallboard 10 duly assembled, the pivoting member 38 pivotally supported on the end portion 10*b* of the fallboard 10 is fixed to the right side board 12, so that the fallboard 10 pivots relative to the pivoting member 38.

Whereas the foregoing paragraphs have described various examples in which the pair of the damper mechanism DM and the mounting section 20 (driving member 23 or driving members 123) constituting the first pivot section J1 is provided on the left side while the pair of the pivoting member 38 and the mounting section 30 (retainer) constituting the second pivot section J2 is provided on the right side, the positional relationship between the two pairs may be reversed as necessary.

In the above-described embodiment, the pair of the damper mechanism DM and the mounting section 20 (driving member 23 or driving members 123) and the pair of the pivoting member 38 and the mounting section 30 (retainer) are provided on the different pivot sections J1 and J2. Such an arrangement corresponds to the case where the driving member(s) 23 (123) is provided on the side of the pivotally supporting structure where the pivoting member 38 is not provided, in which case the driving member(s) 23 (123) (mounting section 20) is fixed to one of the side board 11 and the end portion 10*a* of the fallboard 10 where the damper mechanism DM is not provided (i.e., the end portion 10*a* in the illustrated example of FIG. 2). However, the present invention is not so limited, and the pair of the damper mechanism DM and the mounting section 20 (driving member(s) 23 (123)) and the pair of the pivoting member 38 and the mounting section 30 (retainer) may be provided on the same pivot section J1 or J2. In such a case, the driving member(s) 23 (123)) is constructed to pivot together or integrally with the pivoting member 38. Such a modification is shown in FIG. 6.

Figure 6:
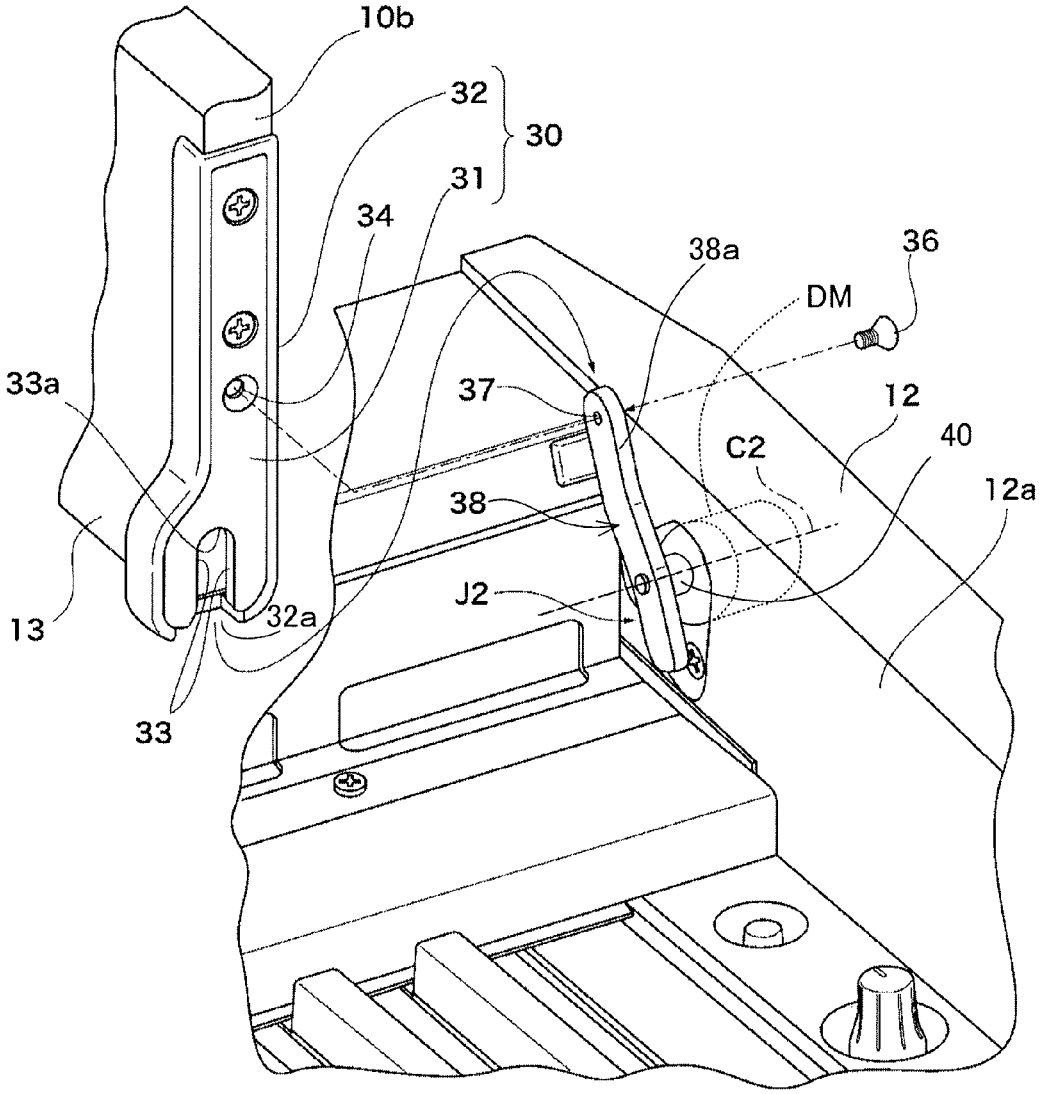
FIG. 6 is a fragmentary exploded perspective view showing a relationship between the right pivot section and the mounting section according to a modification of the present invention.
Figure 7:
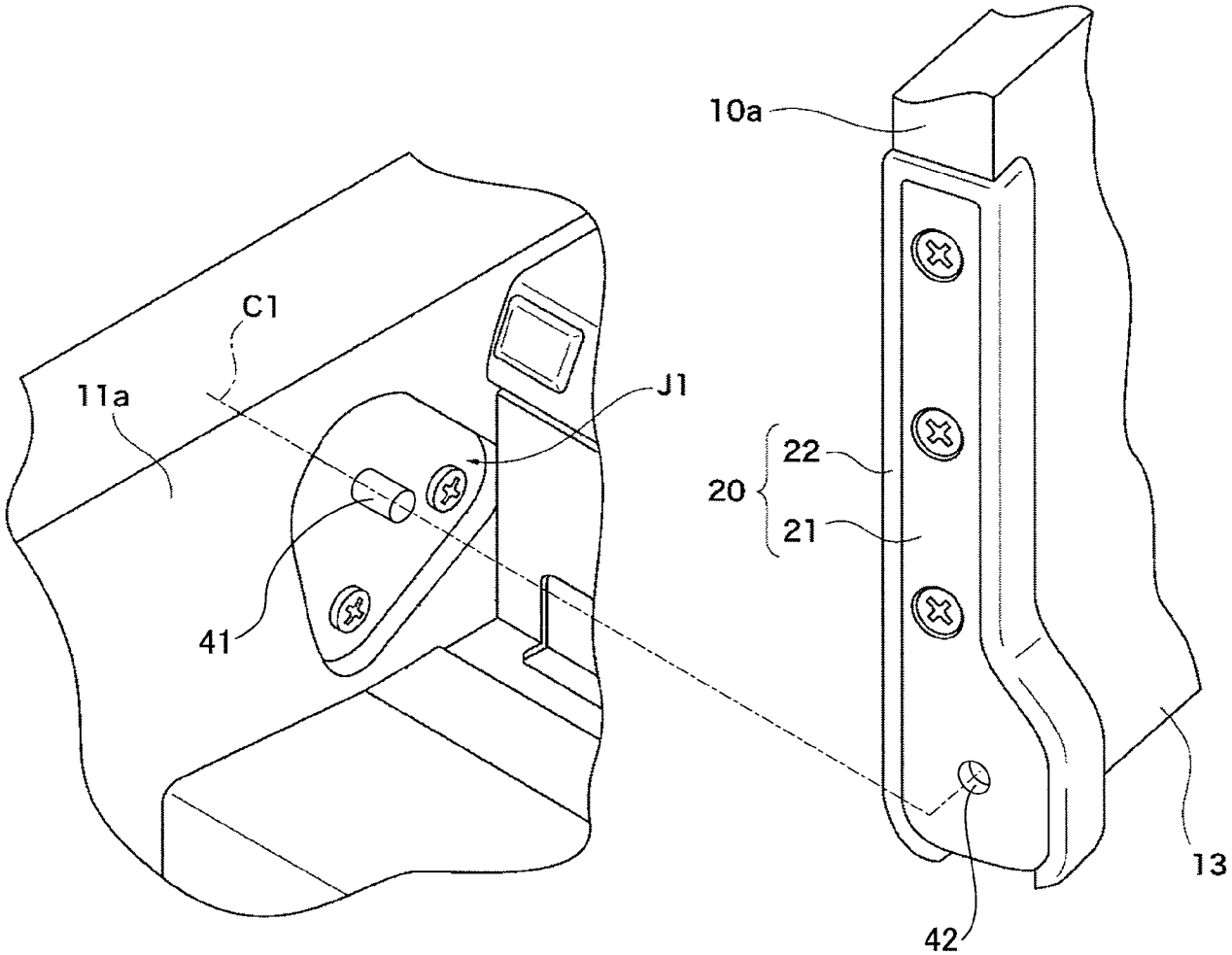
FIG. 7 is a fragmentary exploded perspective view showing a relationship between the left pivot section and the mounting section according to the modification of the present invention

FIG. 6 shows the modification where the pair of the damper mechanism DM and the mounting section 20 (driving member(s) 23 (123)) and the pair of the pivoting member 38 and the mounting section 30 (retainer) are provided on the same pivot section J1 or J2. Note that, in FIG. 6, the same reference numerals and characters as those shown in FIG. 3 represent the same elements as shown in FIG. 3. The damper mechanism DM is incorporated into the right side board 12, and the pivot axis of the damper mechanism DM coincides with the second pivot axis C2. The driven member(s) 29 (129) (not shown in FIG. 6) may be the same as the driven member(s) 29 (129) shown in FIG. 2 or 5. A pivot shaft 40 of the pivoting member 38 has an engaging hole(s) similar to the engaging hole(s) 23 (123) formed therein, and the engaging hole(s) 23 (123) (not shown in FIG. 6) formed in the pivot shaft 40 is fitted over the driven member(s) 29 (129) removably or semi-fixedly. In this manner, the engaging hole(s) 23 (123) corresponding to the damper mechanism DM is constructed to pivot together with the pivoting member 38 corresponding to the retainer (30, 33 and 36). Namely, the arm 38*a* of the pivoting member 38 pivots together with the pivot shaft of the damper mechanism DM. In such a case, the left pivot section J1 may comprise a simple removable pivot shaft structure. FIG. 7 shows an example of the left pivot section J1 comprising such a simple removable pivot shaft structure, where the same reference numerals and characters as those shown in FIG. 2 represent the same elements as in FIG. 2. In this case, the left pivot section J1 includes a cylindrical projection 41 fixed to the left side board 11, and a cylindrical hole 42 formed in the mounting section 20 provided on the left end portion 10*a* of the fallboard 10. With the fallboard 10 duly set to the side boards 11 and 12, the cylindrical hole 42 of the fallboard 10 is pivotably fitted over the cylindrical projection 41 of the left side board 11, so that the fallboard 10 can pivotally move in the opening or closing direction. The pivot axis of the cylindrical projection 41 and cylindrical hole 42 coincides with the first pivot axis C1.

As still another embodiment, the pair of the damper mechanism DM and the driving member(s) 23 (123) may be provided on each of the first and second pivot sections J1 and J2; namely, two pairs of the damper mechanisms DM and the driving members 23 (123) may be provided on the first and second pivot sections J1 and J2. As still another embodiment, the pair of the pivoting member 38 and the retainer may be provided on each of the first and second pivot sections J1 and J2; namely, two pairs of the pivoting members 38 and the retainers may be provided on the first and second pivot sections J1 and J2.

Whereas the present invention has been described above in relation to the preferred embodiments, it is not limited to such particular embodiments, and various other variations and modifications that do not depart from the gist of the present invention are intended to be included in the scope of the present invention.

This application is based on, and claims priority to, JP PA 2014-097473 filed on 9 May 2014. The disclosure of the priority application, in its entirety, including the drawings, claims, and the specification thereof, are incorporated herein by reference.

What is claimed is:

1. A pivotal supporting structure for a fallboard of a keyboard musical instrument, the fallboard being disposed between left and right side boards of the keyboard musical instrument, the pivotal supporting structure comprising:

a first pivot section provided at one of the left or right side board to pivotally support the fallboard;

a second pivot section provided at the other of the left or right side board to pivotally support the fallboard;

a pivot shaft pivotally supported on a first member, which is one of the first pivot section or a first end of the fallboard nearer the first pivot section;

a pivoting member having a pivoting arm fixed to and rotatable with the pivot shaft about a pivoting axis, and extending in a direction perpendicular to the pivoting axis;

a retainer fixed to a second member, which is the other of the first pivot section or the first end of the fallboard, the retainer being separate and discrete from the second member and having an opening and a wall member that forms a gap space extending in the direction perpendicular to the pivoting axis from the opening between the wall member and the second member, the pivoting arm being inserted in the gap space through the opening and positioned and retained at a predetermined position in the gap space;

a damper mechanism having a driven member disposed at a third member, which is one of the second pivot section or a second end of the fallboard opposite the first end, the driven member being configured to be pivoted; and a driving member disposed at a fourth member, which is the other of the second pivot section or the second end of the fallboard, and engageable with the driven member, wherein the damper mechanism is configured to generate a load against pivotal force that the driven member receives from the driving member.

2. The pivotal supporting structure as claimed in claim 1, wherein the retainer receives a fixing member that fixes the pivoting arm inserted and positioned in the gap space.

3. The pivotal supporting structure as claimed in claim 1, wherein the retainer further has a recessed portion disposed in the wall member that engages with the pivot shaft.

4. The pivotal supporting structure as claimed in claim 3, wherein:

the recessed portion has a bottom end portion, and the pivot shaft abuts the bottom end portion.

5. The pivotal supporting structure as claimed in claim 2, wherein the fixing member comprises a fastening screw, and a portion fastened by the fastening screw is exposed when the fallboard is in an opened position.

6. The pivotal supporting structure as claimed in claim 5, wherein the portion fastened by the fastening screw is not visible from outside when the fallboard is in a closed position.

7. The pivotal supporting structure as claimed in claim 1, wherein the driving member is configured to pivot together with the pivoting member.

8. A pivotal supporting structure for a fallboard of a keyboard musical instrument, the fallboard being disposed between left and right side boards of the keyboard musical instrument, the pivotal supporting structure comprising:

a pivot section provided at one of the left or right side board to pivotally support the fallboard;

a pivot shaft pivotally supported on a first member, which is one of the pivot section or an end of the fallboard nearer the pivot section;

a pivoting member having a pivoting arm fixed to and rotatable with the pivot shaft about a pivoting axis, and extending in a direction perpendicular to the pivoting axis;

a retainer fixed to a second member, which is the other of the pivot section or the end of the fallboard, the retainer being separate and discrete from the second member and having an opening and a wall member that forms a gap space extending in the direction perpendicular to the pivoting axis from the opening between the wall member and the second member, the pivoting arm being inserted in the gap space through the opening and positioned and retained at a predetermined position in the gap space; and a damper mechanism having a driven member disposed at one of the first member or the second member, wherein the driven member supports the pivoting arm, and wherein the damper mechanism is configured to generate a load against pivotal force that the driven member receives from the retainer.

9. The pivotal supporting structure as claimed in claim 8, wherein the retainer receives a fixing member that fixes the pivoting arm inserted and positioned in the gap space.

10. The pivotal supporting structure as claimed in claim 8, wherein the retainer further has a recessed portion disposed in the wall member that engages with the pivot shaft.

11. The pivotal supporting structure as claimed in claim 10, wherein:

the recessed portion has a bottom end portion, and the pivot shaft abuts the bottom end portion.

12. The pivotal supporting structure as claimed in claim 9, wherein the fixing member comprises a fastening screw, and a portion fastened by the fastening screw is exposed when the fallboard is in an opened position.

13. The pivotal supporting structure as claimed in claim 12, wherein the portion fastened by the fastening screw is not visible from outside when the fallboard is in a closed position.

14. The pivotal supporting structure as claimed in claim 8, wherein the retainer is configured to pivot together with the pivoting member.

15. A pivotal supporting structure for a fallboard of a keyboard musical instrument, the fallboard being disposed between left and right side boards of the keyboard musical instrument, the pivotal supporting structure comprising:

a first pivot section provided at one of the left or right side board to pivotally support the fallboard;

a second pivot section provided at the other of the left or right side board to pivotally support the fallboard;

a pivot shaft pivotally supported on a first member, which is one of the first pivot section or a first end of the fallboard nearer the first pivot section;

a pivoting member having a pivoting arm fixed to and rotatable with the pivot shaft, and extending in a direction perpendicular to the pivoting axis;

a retainer fixed to a second member, which is the other of the first pivot section or the first end of the fallboard, the retainer being separate and discrete from the second member and having an opening and a wall member that forms a gap space extending in the direction perpendicular to the pivoting axis from the opening between the wall member and the second member, the pivoting arm being inserted in the gap space through the opening and positioned and retained at a predetermined position in the gap space;

a damper mechanism having a driven member disposed at a third member, which is one of the first pivot section, the second pivot section, the first end of the fallboard, or a second end of the fallboard opposite the first end of the fallboard, the driven member being configured to be pivoted, wherein the damper mechanism is configured to generate a load against pivotal force that the driven member receives.

* * * * *